United States Patent [19]

Scherer

[11] Patent Number: 4,589,601

[45] Date of Patent: May 20, 1986

[54] METHOD OF WINDING BRAZE STRIP MATERIAL

[75] Inventor: Albert R. Scherer, Cupertino, Calif.

[73] Assignee: GTE Products Corporation, Stamford, Conn.

[21] Appl. No.: 737,768

[22] Filed: May 28, 1985

[51] Int. Cl.[4] ..... B65H 18/08; B65H 75/18

[52] U.S. Cl. ..... 242/1; 242/55; 242/71.8; 242/67.1 R

[58] Field of Search ..... 242/1, 55, 54 R, DIG. 2, 242/103, 105, 67.1 R, 67.2, 77.3, 117, 118.4, 71.8, 159, 176; 206/389; 228/246

[56] References Cited

U.S. PATENT DOCUMENTS

| | | | |
|---|---|---|---|
| 1,265,110 | 5/1918 | Prentiss | 242/118.4 |
| 1,690,976 | 11/1928 | Henry, Jr. | 242/1 X |
| 2,225,180 | 12/1940 | Olesen | 242/118.4 |
| 3,337,150 | 8/1967 | Roys | 242/71.8 X |
| 3,350,028 | 10/1967 | Lear | 242/71.8 |
| 3,377,904 | 4/1968 | Olson | 206/389 X |
| 4,196,864 | 4/1980 | Cole | 242/54 R |
| 4,482,100 | 11/1984 | Yoshida | 242/DIG. 2 X |

FOREIGN PATENT DOCUMENTS

| | | | |
|---|---|---|---|
| 23320 | of 1905 | United Kingdom | 242/118.4 |

*Primary Examiner*—John M. Jillions

*Attorney, Agent, or Firm*—James Theodosopoulos

[57] ABSTRACT

A spool for L-shaped brazing alloy strip comprises a flange with a hub acutely angularly disposed thereto. The strip is wound on the spool so that the turns nest into each other.

6 Claims, 2 Drawing Figures

METHOD OF WINDING BRAZE STRIP MATERIAL

Figure 1:
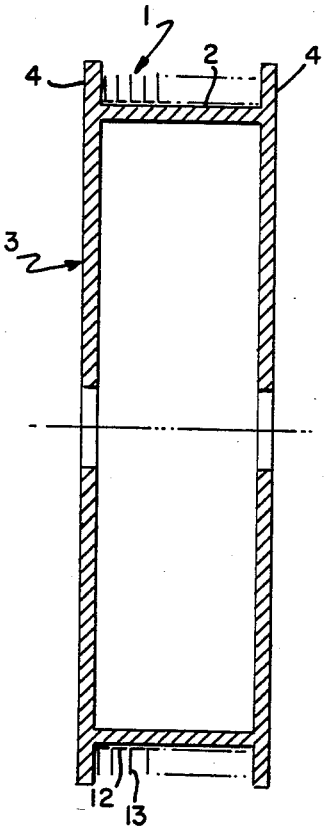
(PRIOR ART) FIG. 1

This invention concerns the L shaped brazing alloy strip disclosed in U.S. Pat. No. 3,056,195, incorporated herein by reference. It is especially concerned with the method of winding a long length of such strip on a spool. The shorter dimension of the L or the leg, referred to in the patent as the non-serrated portion, is continuous, and the longer dimension of the L, referred to in the patent as the serrated portion or ears, is slotted, as shown in the patent. The slotted construction of the strip permits it to be shaped into the configurations shown in the patent drawing. However, the slotted construction also presents a problem when a long length of the strip is wound on a spool. In the prior art the strip was wound on a spool as shown in FIG. 1 herein. The leg portion of the strip was wound on the hub of the spool and the turns were wound adjacent to each other. However the problem was that the turns easily became entangled, which made the winding of the strip on the spool, and the unwinding therefrom, time consuming.

Figure 2:
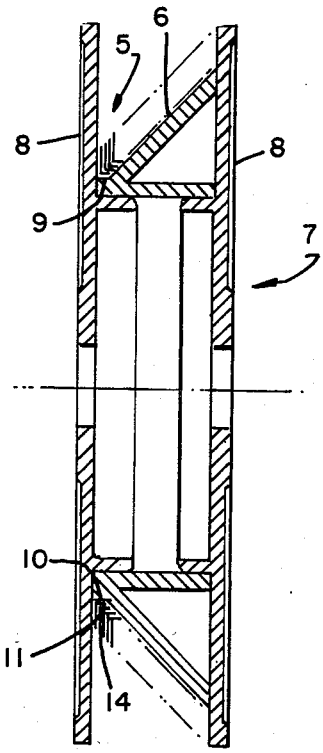

My invention solved the problem. Instead of making the hub of the spool straight, that is to say, orthogonal to the flanges of the spool, I make the hub angular with respect to the flanges, as shown in FIG. 2. This now permits the turns to be nested into each other, as shown in FIG. 2. In addition to solving the entangling problem, this nesting permits a longer length of strip to be wound on each spool.

In the drawing, FIG. 1 is a sectional view of L shaped brazing alloy strip wound on a prior art spool. FIG. 2 shows the strip nestedly wound on a spool as per this invention.

In FIG. 1, L shaped brazing alloy strip 1 is wound on hub 2 of spool 3 between flanges 4. Hub 2 is orthogonal to flanges 4. In FIG. 2, L shaped brazing alloy strip 5 is wound on hub 6 of spool 7 between flanges 8. Hub 6 is angular with respect to flanges 8 except for straight portion 9 of hub 6 which accommodates leg portion 10 of first turn 11 of strip 5.

For clarity, the leg portion and ear portions of the brazing alloy strip are identified in FIG. 1 as leg portion 12 and ear portion 13, and in FIG. 2 as leg portion 10 and ear portion 14.

In one example, strip 5 was 7200 inches long and was made of 2 mil thick Cusil alloy, which consisted of 72% silver-28% copper. Leg portion 10 of the strip was 60 mils long and each ear portion 14 was 187 mils long. The slots occurred every 170 mils. Hub 6 of spool 7 had straight portion 9 which was 60 mils long, the same length as leg portion 10, to accommodate first turn 11. Subsequent turns nested into each other, that is to say, the leg of the second turn, for example, rested on the leg of the first turn and the ears of the second turn rested against the ears of the first turn. Subsequent turns similarly rested into each other. Except for straight portion 9, the remainder of hub 6 was angled. The optimum angle is 45°.

As the strip is wound on the spool, the slots can open up, as shown in FIG. 2 of U.S. Pat. No. 3,056,195. I have found that in order to prevent the slots from opening too much and, therefore, in order to prevent entangling of the slotted portions or ears into each other, the ratio of the minimum diameter of the hub to slot length, which is the same as the ear portion length, should be at least eight.

I claim:

1. The method of winding a long length of L shaped slotted brazing alloy strip on a spool, the strip comprising a leg portion and an ear portion orthogonal thereto, the method comprising the steps of providing a spool having a hub and a flange, the hub being acutely angularly disposed with respect to said flange, winding a first turn of said strip on said spool so that the ear portion of said first turn bears against said flange and the leg portion of said first turn rests on said hub, and winding a second turn of said strip onto said first turn so that the ear portion of said second turn bears against the ear portion of the first turn and the leg portion of said second turn rests on the leg portion of the first turn.

2. A spool comprising a hub and a flange, the flange being acutely angularly disposed with respect to the flange, there being a long length of L shaped slotted brazing alloy strip wound on the spool, the alloy strip comprising a leg portion and an ear portion orthogonal thereto, the first turn of the strip being wound so that the ear portion thereof bears against the flange and the leg portion thereof rests on the hub, the second turn of the strip being wound on the first turn so that the ear portion of the second turn bears against the ear portion of the first turn and the leg portion of the second turn rests on the leg portion of the first turn.

3. The spool and strip thereon of claim 2 wherein the hub has a straight portion orthogonal to the flange to accommodate the first turn of the strip.

4. The spool and strip thereon of claim 2 wherein the hub is disposed at a 45 degree angle with respect to the flange.

5. The spool and strip thereon of claim 2 wherein the hub has a diameter that is at least eight times greater than the length of the ear portion of the brazing alloy strip.

6. The spool and strip thereon of claim 2 wherein there are a plurality of turns of brazing alloy strip wound on the spool, the turns nesting into each other as the second turn nests into the first turn.

* * * * *